US011459137B2

(12) United States Patent
Mader et al.

(10) Patent No.: US 11,459,137 B2
(45) Date of Patent: Oct. 4, 2022

(54) TRAY SEALING MACHINE

(71) Applicant: MULTIVAC SEPP HAGGENMUELLER SE & CO. KG, Wolfertschwenden (DE)

(72) Inventors: Andreas Mader, Dietmannsried (DE); Albert Gabler, Lachen-Albishofen (DE); Dominik Harlacher, Wiggensbach (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 129 days.

(21) Appl. No.: 16/865,877

(22) Filed: May 4, 2020

(65) Prior Publication Data

US 2020/0346803 A1 Nov. 5, 2020

(30) Foreign Application Priority Data

May 3, 2019 (DE) ..... 102019206392.6

(51) Int. Cl.
*B65B 31/02* (2006.01)
*B65B 7/16* (2006.01)
*B65B 9/04* (2006.01)

(52) U.S. Cl.
CPC ..... *B65B 31/028* (2013.01); *B65B 7/162* (2013.01); *B65B 9/04* (2013.01)

(58) Field of Classification Search
CPC ..... B65B 31/025; B65B 31/028; B65B 7/162; B65B 7/164; B65B 9/04; B65B 7/2878
See application file for complete search history.

(56) References Cited

U.S. PATENT DOCUMENTS 3,659,393 A * 5/1972 Richter ..... B65B 31/021 53/511
3,908,334 A * 9/1975 Rychiger ..... B65B 7/164 53/86

(Continued)

FOREIGN PATENT DOCUMENTS

EP 2 272 766 A1 1/2011
EP 3034416 B1 * 2/2017 ..... B29C 65/02
WO 2011/092103 A1 8/2011

OTHER PUBLICATIONS

German Search Report dated Jan. 7, 2020, Application No. 10 2019 206 392.6, Applicant Multivac Sepp Haggenmueller SE & Co. KG, 7 Pages.

(Continued)

*Primary Examiner* — Joshua G Kotis
(74) *Attorney, Agent, or Firm* — Brooks Kushman P.C.

(57) ABSTRACT

A tray sealing machine is provided with a frame on which a sealing tool is arranged. The sealing tool comprises a lower tool in which a tray to be sealed can be received and an upper tool including a hood, a sealing component arranged in the interior of the hood, and a sealing component carrier on which the sealing component is arranged. The hood is movable relative to the sealing component and has a gas connection configured for connection to a corresponding gas connection of the tray sealing machine. The lower tool and the hood are configured to form a sealing chamber in a closed state of the sealing tool. The sealing tool further comprises a line connecting the gas connection to the sealing chamber in the closed state. The hood is movable relative to the frame and the sealing component carrier is unmovable relative to the frame.

15 Claims, 5 Drawing Sheets

(56) References Cited

U.S. PATENT DOCUMENTS

| | | | | |
|---|---|---|---|---|
| 4,909,022 | A * | 3/1990 | Kubis | B29C 65/18 53/510 |
| 4,982,555 | A | 1/1991 | Ingemann | |
| 6,488,972 | B1 * | 12/2002 | Cerani | B65D 77/20 53/442 |
| 6,834,476 | B2 * | 12/2004 | Konishi | B65B 7/164 53/329.4 |
| 6,912,828 | B1 * | 7/2005 | Yamay | B29C 66/8322 53/432 |
| 9,266,635 | B2 * | 2/2016 | Ickert | B29C 66/92921 |
| 10,710,272 | B2 * | 7/2020 | Tall | B29C 64/10 |
| 10,946,556 | B2 * | 3/2021 | Ederer | B28B 1/14 |
| 2011/0072764 | A1 | 3/2011 | Daniek et al. | |
| 2012/0204516 | A1 * | 8/2012 | Palumbo | B65B 11/52 53/403 |
| 2012/0285126 | A1 * | 11/2012 | Vaccari | B29C 66/8161 53/510 |
| 2016/0068288 | A1 * | 3/2016 | Palumbo | B29C 66/24244 53/511 |
| 2016/0083125 | A1 * | 3/2016 | Oberdorfer | B65B 43/04 53/558 |
| 2017/0029146 | A1 * | 2/2017 | Palumbo | B65B 47/10 |
| 2017/0305585 | A1 * | 10/2017 | Rizzi | B29C 65/7847 |
| 2018/0155074 | A1 * | 6/2018 | Gabler | B65B 31/028 |
| 2018/0346167 | A1 * | 12/2018 | Capriotti | B65B 7/164 |
| 2019/0031379 | A1 * | 1/2019 | Palumbo | B65B 61/18 |

OTHER PUBLICATIONS

European Search Report dated Oct. 2, 2020, Application No. 20163603.2-1016, Applicant Multivac Sepp Haggenmueller SE & Co. KG, 7 Pages.

* cited by examiner

TRAY SEALING MACHINE

CROSS-REFERENCE TO RELATED APPLICATIONS

This application claims foreign priority benefits under 35 U.S.C. § 119(a)-(d) to German patent application number DE 102019206392.6, filed May 3, 2019, which is incorporated by reference in its entirety.

TECHNICAL FIELD

The disclosure relates to tray sealing machines.

BACKGROUND

In the sealing tool disclosed in WO 2011 092 103 A1, both a lower as well as an upper tool component are provided completely movable. Upper tool components are usually structured with much more complexity, e.g., having gas lines for evacuation and/or gas flushing as well as electrical supply lines, e.g., for heating elements of a sealing plate. For this reason, motions can, on one hand, lead to shorter operating times or higher maintenance costs, respectively, since in particular electrical cables, and especially those with large cable cross-sections, can withstand only to a limited extent a strains occurring due to repeated motions in the form of bending processes. On the other hand, the cable cross-section usable for electrical supply lines is limited by the motions, since bending is hardly possible with increasing cable cross-sections. The heating capacity of heating elements depends on the current that they are supplied. The cable cross-section therefore limits the current and consequently the heating power.

SUMMARY

It is an object of the present disclosure to specify a tray sealing machine, which is improved in a manner as simple as possible in terms of maintenance effort and performance.

The disclosure provides a tray sealing machine with a frame on which a sealing tool is arranged. The sealing tool comprises a lower tool in which a tray to be sealed can be received. The sealing tool furthermore comprises an upper tool which comprises a hood and a sealing component arranged in the interior of the hood. The hood is movable relative to the sealing component and has a gas connection which is configured for a connection to a corresponding gas connection of the tray sealing machine. The upper tool furthermore comprises a sealing component carrier on which the sealing component is arranged in a movable or unmovable manner. The lower tool and the hood are configured to form a sealing chamber in a closed state of the sealing tool. The sealing tool furthermore comprises a line, which, in the closed state of the tool, connects the gas connection to the sealing chamber, wherein a first line section runs through the lower tool and in the closed state of the tool is connected to a second line section, which leads to the gas connection, at least partially runs through the hood, and is connected to the hood in an unmovable manner. The hood is movable relative to the frame. The sealing component carrier is unmovable relative to the frame.

Lines and/or line sections may be regarded as running through a structure or partially running through a structure in particular if they or parts of them run within the respective structure. The hood may be movable in particular relative to the sealing component carrier. The movability of the hood relative to the frame and relative to the sealing component may advantageously allow for the motions performed by the sealing component carrier and/or the sealing component during the sealing process to be minimized or even eliminated.

Since the sealing component must be heated for sealing and this may be done in particular by electric heating devices requiring high currents, electrical supply lines to the sealing component carrier and/or the sealing component may have large cable cross-sections. They may make larger motions difficult or be damaged thereby due to the many repetitions. By reducing or eliminating the motions performed by the sealing component carrier and/or the sealing component during the sealing process, the durability in supply lines unchanged as compared to prior art ones may be increased or, with comparable durability, the cable cross-section may be enlarged versus the prior art, which may enable a higher heating performance.

It is conceivable that both the first line section and the second line section are connected to the sealing chamber. This may be advantageous in particular if the line is used for the evacuation of the sealing chamber. In such a case, the first line section may, by the connection to the sealing chamber, be configured to, for example, enable the evacuation of a part of the sealing chamber formed by the inserted tray and the lower tool and/or a space between the tray and the top film. The second line section may, by the connection to the sealing chamber, be configured to enable the evacuation of a part of the sealing, chamber formed by the top film and the hood.

In an advantageous variant, the second line section may run completely within a hood wall. Any structure of the hood whose one side, e.g., an inner side, faces the sealing chamber, and whose side opposite the one side, e.g., an outer side, faces the outer environment of the sealing tool may be considered as a hood wall. These may be, in particular, side walls or ceiling walls. Line sections running entirely in the hood wall may have the advantage that they cannot come into contact with other components of the tray sealing machine, in particular the sealing tool, when the hood moves, thereby the risk of damage to the line section or the respective component may be reduced.

It is conceivable that the hood is slidable relative to the frame in a closing direction by the lower tool. In the open state of the sealing tool, this may allow the hood to be positioned closer to the lower tool than the sealing component and/or the sealing component carrier. This may allow the sealing chamber to be formed first, namely, when the lower tool bears against the hood, while the sealing tool closes. Subsequently, the lower tool may be approached to the sealing component and/or the sealing component carrier by being moved further in the closing direction, for example, to facilitate and/or enable sealing.

It is particularly advantageous for the hood to alternatively or additionally be slidable relative to the sealing component carrier in a closing direction by the lower tool. In the open state of the sealing tool, this as well may allow for the hood to be positioned closer to the lower tool than the sealing component and/or the sealing component carrier. This may allow the sealing chamber to be formed first, namely when the lower tool bears against the hood, while the sealing tool closes. Subsequently, the lower tool may be approached to the sealing component and/or the sealing component carrier by being moved further in the closing direction, for example, to facilitate and/or enable sealing.

A further advantageous variant provides the tray sealing machine described above, with a second gas connection arranged on the hood and a second line, which, in the closed state of the tool, connects the second gas connection to the sealing chamber, wherein a first line section of the second line runs through the lower tool and in the closed state of the tool is connected to a second line section of the second line, which leads to the second gas connection, at least partially runs through the hood, and is connected to the hood in an unmovable manner. With this configuration, for example, a line for evacuating and a line for gas flushing may be provided separately. This may be particularly advantageous for the reason that it is advantageous, firstly, to evacuate the entire sealing chamber. Secondly, it may be advantageous to gas-flush exclusively the space between the tray and the top film, since in this way, less of the gas used for gas flushing may be required. The second gas connection may be configured for a connection to a second corresponding gas connection of the tray sealing machine.

It is conceivable that the second line section of the second line runs entirely within a hood wall. As already mentioned, line sections running entirely in the hood wall may have the advantage that they cannot come into contact with other components of the tray sealing machine, in particular the sealing tool, when the hood moves. Thereby, the risk of damage to the line section or the respective component may be reduced. In order to avoid further repetition, reference is also made to the above explanations with regard to the term "hood wall", which are also applicable with regard to the second line or the second line section of the second line, respectively.

In a variant, the line may be arranged on a first side of the sealing tool and the second line may be arranged on a second, different side of the sealing tool. This may reduce the structural complexity of the hood, as the space available for the running of the respective line may be limited on the respective side. It is particularly advantageous if the first side is opposite the second side in relation to a direction of production. The direction of production may be considered to be a direction in which the trays to be sealed are conveyed through the packaging machine.

It may be advantageous if the hood is produced in a generative process. Any manufacturing process in which a workpiece, such as the hood in the present case, is successively generated by adding additional material may be considered a generative process. Such a process may not depend on the use of (casting) molds or inserts. In particular, the workpiece may be generated in layers. The added raw material may be liquid, powdery, wire-like or film-like material. For example, metals or polymers may be used. Such a process may allow for the paths of lines running through and or within the hood wall to be designed in a more flexible manner, since workpieces produced in generative processes are subject to fewer restrictions, in particular in terms of cavities inside the respective workpiece.

BRIEF DESCRIPTION OF THE DRAWINGS

The disclosure relates to a tray sealing machine of the kind described above. In the following, an embodiment of the disclosure is further described with reference to the appended drawings.

DETAILED DESCRIPTION

Figure 1:
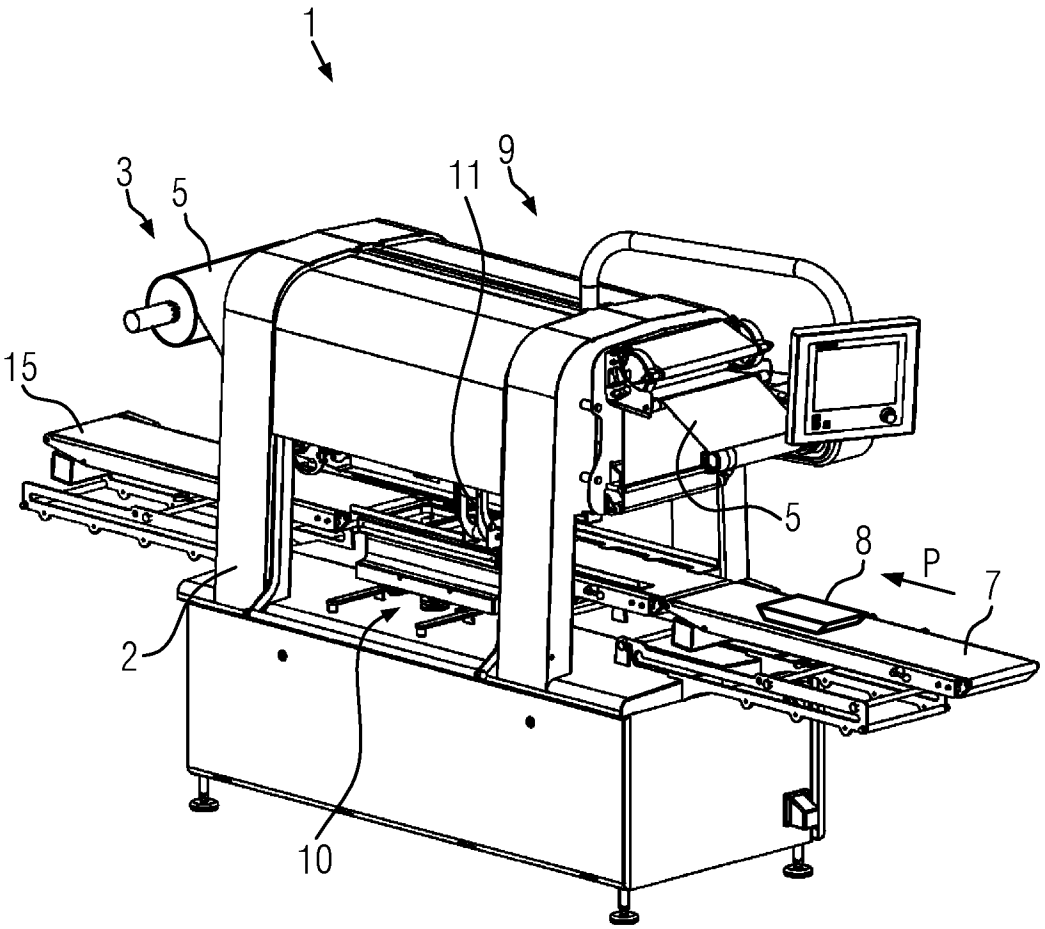
FIG. 1 shows a schematic perspective view of a packaging machine.

FIG. 1 shows an example of a packaging machine 1 which, as in the present example, may be a tray sealing machine. It may comprise a frame 2. Packaging machine 1 may also have a feed belt 7. It may also have a sealing station 9. By use of feed belt 7, trays 8 that are filled but at this time not yet sealed may be transported to sealing station 9. Trays 8 may be relocated with a gripper device 11 in a production direction P into sealing station 9 and there they may be sealed with a top film 5 (film) supplied from above, for example, by sealing top film 5 thereunto. For this purpose, sealing station 9 may comprise a sealing tool 10 which shall be described later in more detail. The packagings thus completed may be relocated by gripper device 11 from sealing station 9 to a discharge belt 15.

After sealing top film 5 thereonto, regions of top film 5 corresponding to the packagings or packaging assemblies may he cut out of the web of top film 5 in sealing station 9. There remains a film lattice of top film 5 which is wound by a device 3 for winding film 5.

Figure 2:
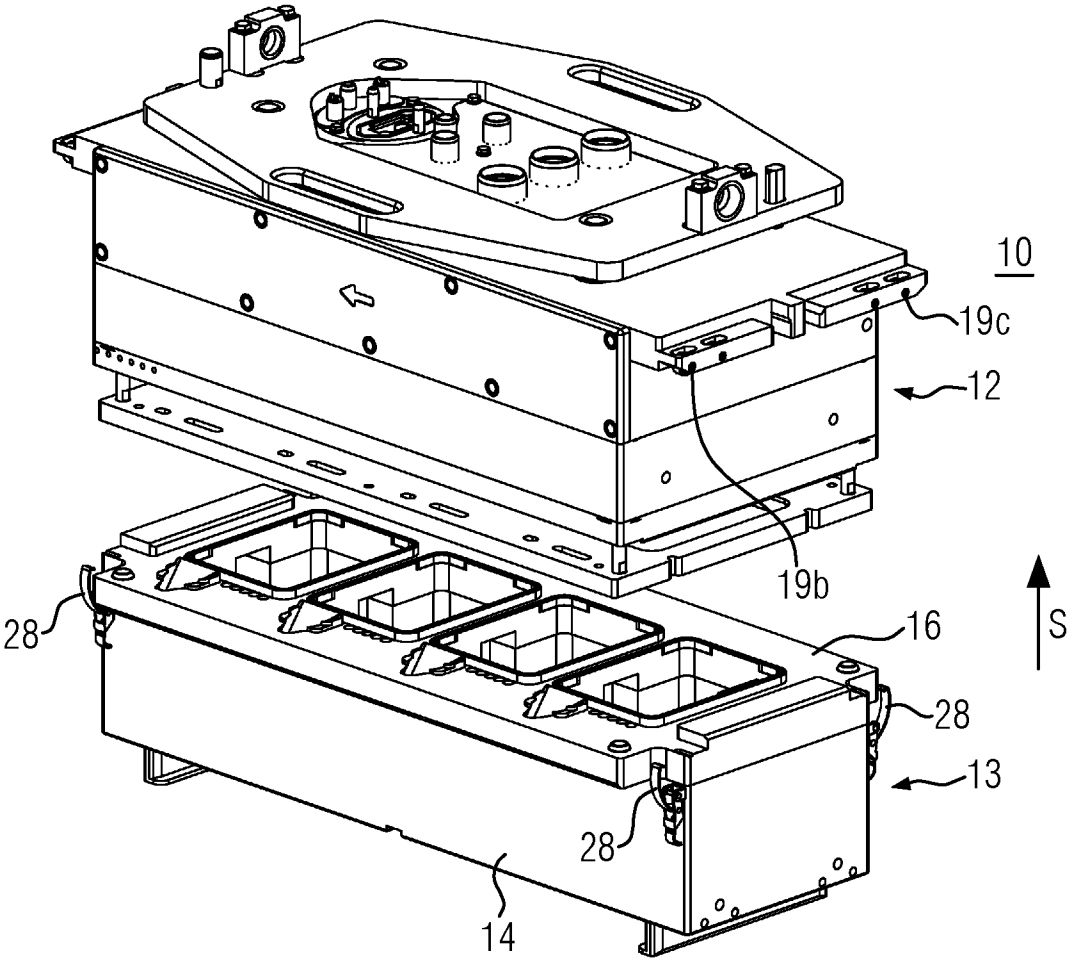
FIG. 2 shows a schematic perspective view of a sealing tool in an open state.

Sealing tool 10 can be seen in a perspective view in FIG. 2. As in the embodiment shown, sealing tool 10 may comprise an upper tool 12 and a lower tool 13. They may be moved towards each other in a closing direction S in order to close sealing tool 10. Lower tool 13 may contain a main body 14, as shown in the figure. It may be mounted, for example, on a lifting unit 6 (see FIG. 4), which may be configured to move lower tool 13 in closing direction S towards upper tool 12.

Figure 3:
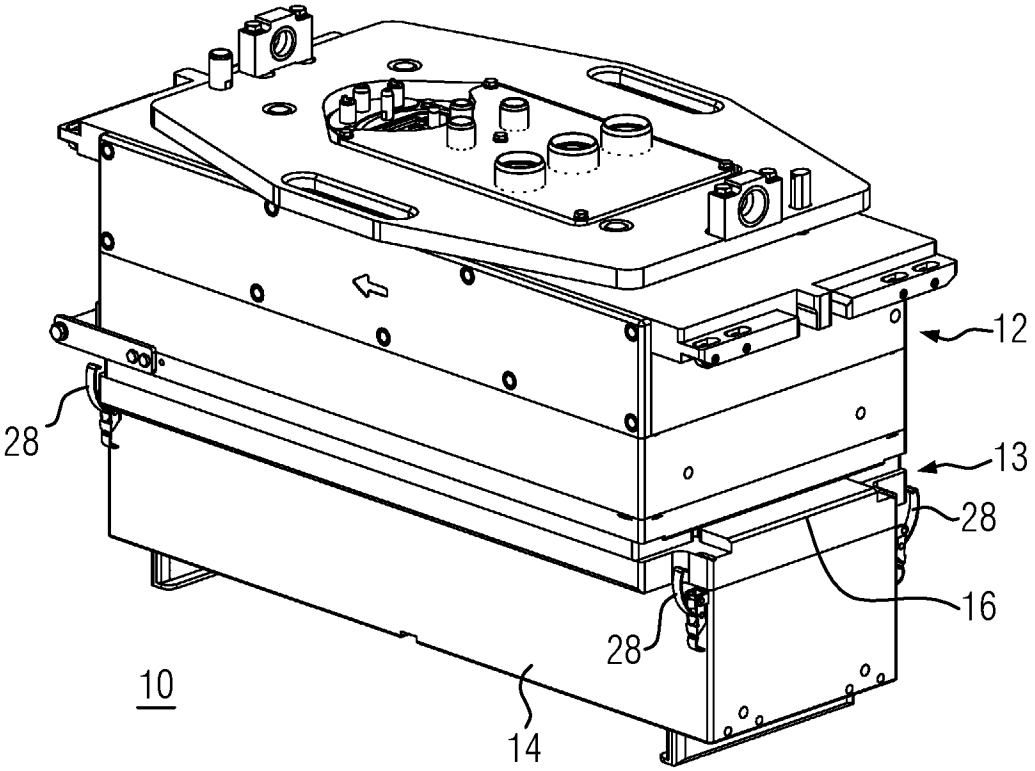
FIG. 3 shows a schematic perspective view of a sealing tool in a closed state.

A tray carrier 16, which is configured to receive the trays 8 may be arranged on the main body 14. Tray carrier 16 may be held on main body 14 by attachment devices 28 which may preferably be operable without tools. The person skilled in the art recognizes that FIG. 2 shows an open state of sealing tool 10. FIG. 3 shows sealing tool 10 in a closed state.

Figure 4:
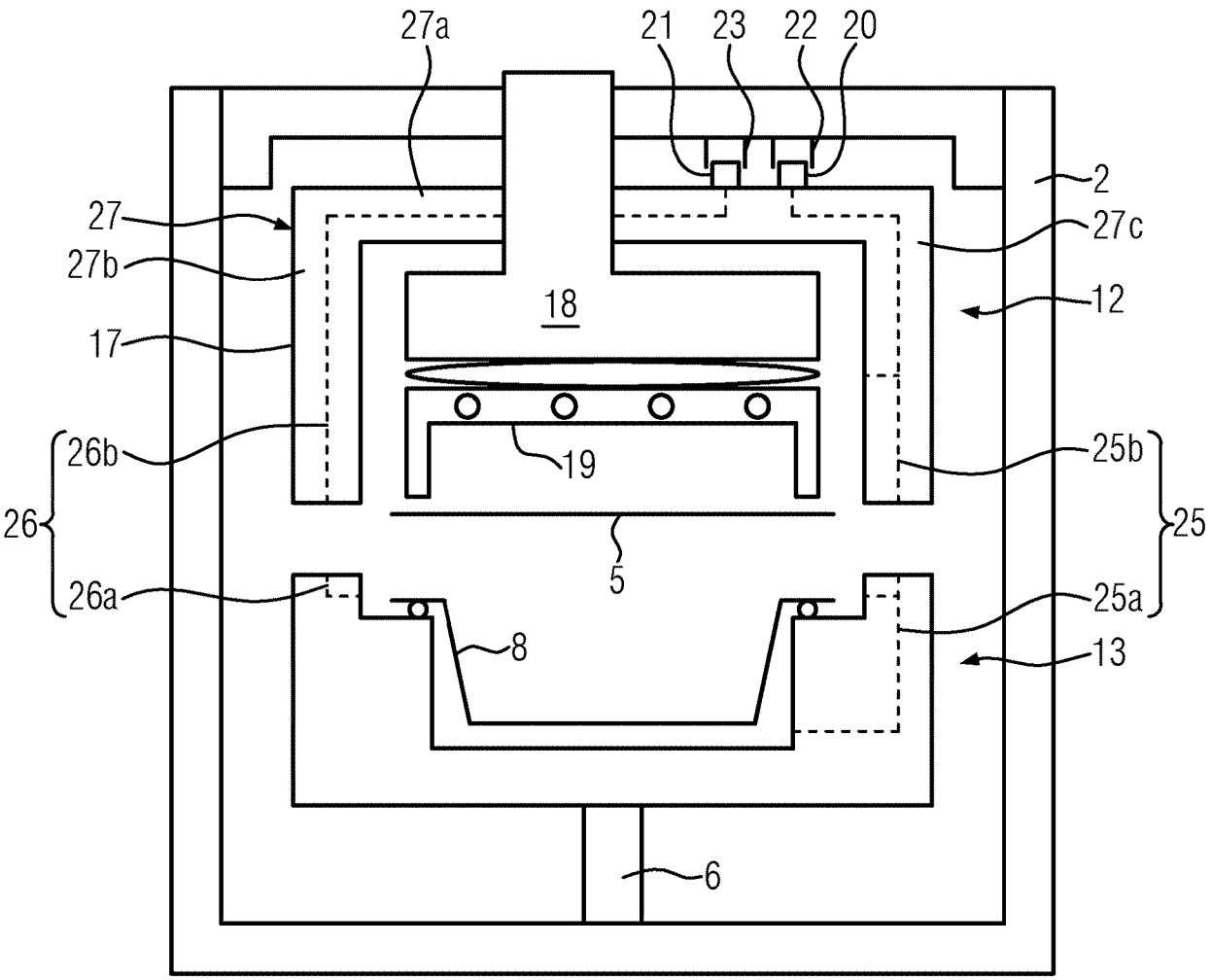
FIG. 4 shows a schematic sectional view of a tray sealing machine with a sealing tool in an open state.

FIG. 4 shows a schematic sectional view of tray sealing machine 1. The cutting plane runs perpendicular to production direction P. Components of upper tool 12 can now be seen in more detail. Upper tool 12 may comprise a hood 17. It may be formed at least partially by a hood wall 27. As in the present embodiment, hood wall 27 may comprise a cover wall 27*a* and several side walls 27*b*, 27*c*.

Furthermore, upper tool 12 may comprise a sealing component carrier 18. A sealing component 19 may be arranged thereon. Sealing component carrier 18 may be provided unmovable relative to frame 2. Hood 17 may be movable relative to frame 2 and to sealing component carrier 18.

Hood 17 may have a first gas connection 20. It may also have a second gas connection 21. First gas connection 20 may be connected to a corresponding first port or gas connection 22. The latter may be arranged on tray sealing machine 1, in particular on frame 2. Second gas connection 21 may be connected to a corresponding gas connection 23. The latter may be arranged on tray sealing machine 1, in particular on frame 2. The person skilled in the art recognizes that sealing tool 10 in FIG. 4 is shown in an open state.

Figure 5:
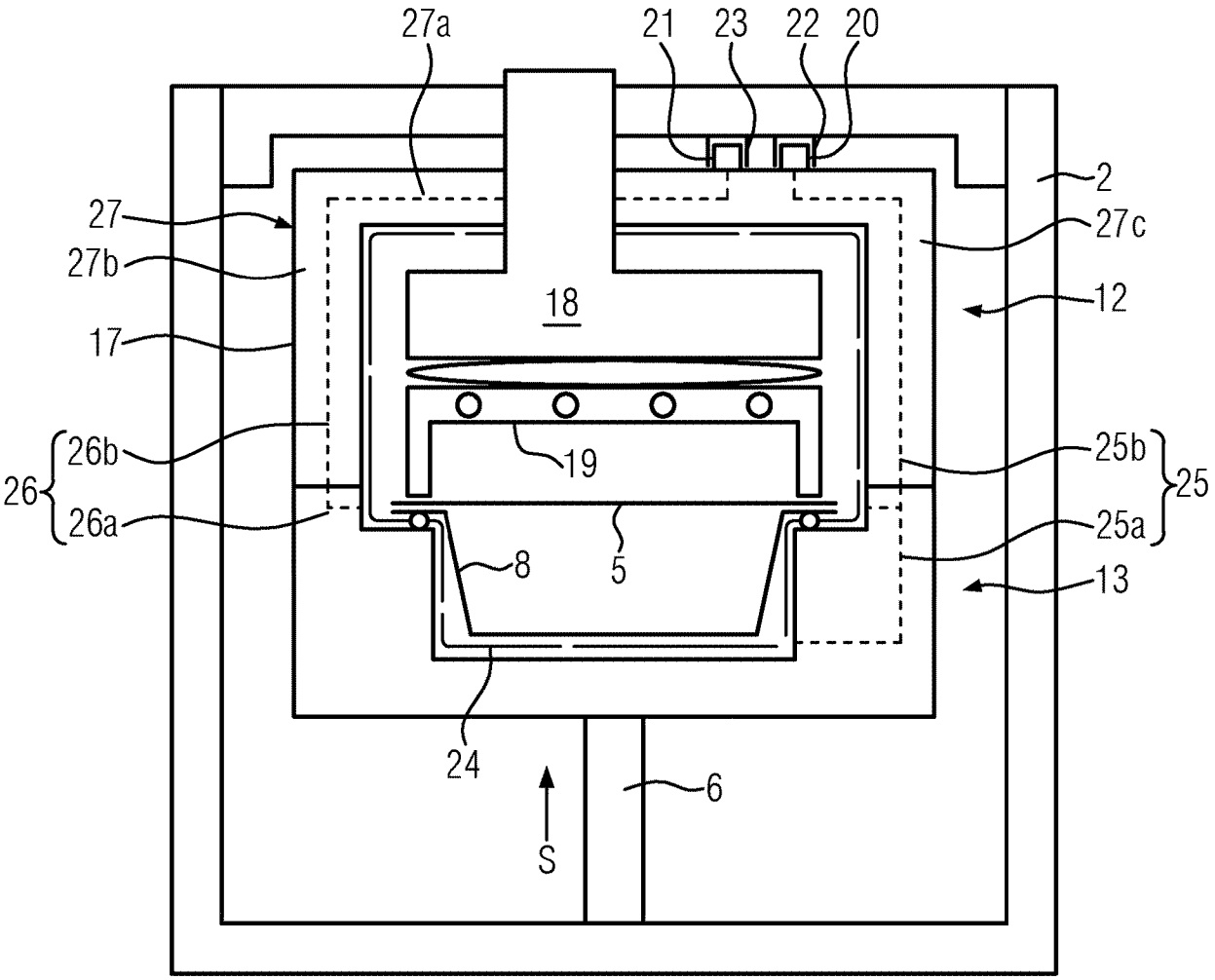
FIG. 5 shows a schematic sectional view of a tray sealing machine with a sealing tool in a closed state.

FIG. 5 shows the view from FIG. 4. However, sealing tool 10 is shown in a closed state. To achieve this state, lifting unit 6 may be configured to move lower tool 13 in closing direction S towards upper tool 12. By having hood 17 and lower tool 13 bear against each other, a sealing chamber 24 (see long dashed line) may be formed. Sealing chamber 24 may be sealed in a gas-tight manner against the environment of sealing tool 10. As in the present embodiment, hood 17 (FIG. 5) may be raised in the closed state as compared to the open state (FIG. 4). This may be done in that lower tool 13, which may be raised by lifting unit 6, slides hood 17 in closing direction S.

Sealing tool 10 may comprise a first line 25. It may comprise a first line section 25*a* and a second line section 25*b*. First line section 25*a* may run through lower tool 13, in particular entirely within the lower tool 13, and is therefore indicated by a short dashed line. Second line section 25*b* may run partially or, as in the present embodiment, entirely within hood 17, in particular inside hood wall 27, and is therefore also indicated by a dashed line. It may also lead to first gas connection 20.

In the closed state shown in FIG. 5, first line 25 may connect first gas connection 20 to sealing chamber 24. Both first line section 25*a* and second line section 25*b* may be connected to sealing chamber 24. In the embodiment described, first line 25 may be configured to enable an evacuation of sealing chamber 24. For this purpose, first port 22 of tray sealing machine 1 may be connected to a vacuum generator (not shown).

Sealing tool 10 may comprise a second line 26 in addition to first line 25. The second line 26 may likewise comprise a first line section 26*a* and a second line section 26*b*. First line section 26*a* may run through lower tool 13, in particular entirely within lower tool 13, and is therefore indicated by a short dashed line. Second line section 26*b* may run partially or, as in the present embodiment, entirely within hood 17, in particular in the interior of hood wall 27, and is therefore likewise indicated by a dashed line. It may furthermore lead into second gas connection 21.

In the closed state shown in FIG. 5, second line 26 may connect second gas connection 21 to sealing chamber 24. In the case of second line 16, it is conceivable that only first line section 26*a*, but not second line section 26*b*, is connected to sealing chamber 24. This may be the case in particular when, as in the present embodiment, second line 26 is configured to enable gas-flushing of tray 8 to be sealed. For this purpose, second port 23 of tray sealing machine 1 may be connected to a gas source (not shown).

What is claimed is:

1. A tray sealing machine comprising:

a frame;

a sealing tool arranged on the frame, the sealing tool comprising:

a lower tool in which a tray to be sealed can be received;

an upper tool which comprises a hood and a sealing component arranged in an interior of the hood, wherein the hood is movable relative to the sealing component and has a first gas connection which is configured for a connection to an additional gas connection of the tray sealing machine, wherein the upper tool furthermore comprises a sealing component carrier on which the sealing component is arranged;

wherein the lower tool and the hood are configured to form a sealing chamber in a closed state of the sealing tool;

a first line, which, in the closed state of the sealing tool, connects the first gas connection to the sealing chamber, the first line including a first line section and a second line section, wherein the first line section runs through the lower tool and, only in the closed state of the sealing tool, is connected to the second line section, which leads to the first gas connection, at least partially runs through the hood, and is connected to the hood in an unmovable manner;

wherein the hood is movable relative to the frame and the sealing component carrier is unmovable relative to the frame.

2. The tray sealing machine according to claim 1, wherein the sealing component is arranged on the sealing component carrier in a movable manner.

3. The tray sealing machine according to claim 1, wherein both the first line section and the second line section are connected to the sealing chamber.

4. The tray sealing machine according to claim 1, wherein the second line section runs entirely within a hood wall of the hood.

5. The tray sealing machine according to claim 1, wherein the hood is slidable relative to the frame by the lower tool in a closing direction.

6. The tray sealing machine according to claim 1, wherein the hood is slidable relative to the sealing component carrier by the lower tool in a closing direction.

7. The tray sealing machine according to claim 1, further comprising a second gas connection arranged on the hood and a second line, which, in the closed state of the sealing tool, connects the second gas connection to the sealing chamber, wherein a first line section of the second line runs through the lower tool and in the closed state of the sealing tool is connected to a second line section of the second line, which leads to the second gas connection, at least partially runs through the hood, and is connected to the hood in an unmovable manner.

8. The tray sealing machine according to claim 7, wherein the second line section of the second line runs entirely within a hood wall of the hood.

9. The tray sealing machine according to claim 8, wherein the first line is arranged on a first side of the sealing tool and the second line is arranged on a second, different side of the sealing tool.

10. The tray sealing machine according to claim 7, wherein the first line is arranged on a first side of the sealing tool and the second line is arranged on a second, different side of the sealing tool.

11. The tray sealing machine according to claim 10, wherein the first side is opposite the second side in relation to a direction of production.

12. The tray sealing machine according to claim 7, wherein the first line section of the second line is disconnected from the second line section of the second line when the sealing tool is in an open state.

13. The tray sealing machine according to claim 1, wherein the hood is produced in a generative process.

14. The tray sealing machine according to claim 1, wherein the additional gas connection is arranged on the frame.

15. A tray sealing machine comprising:

a frame;

a first gas connection arranged on the frame; and a sealing tool arranged on the frame, the sealing tool comprising:

a lower tool in which a tray to be sealed can be received;

an upper tool that comprises a hood, a sealing component arranged in an interior of the hood, and a sealing component carrier on which the sealing component is arranged, wherein the hood is movable relative to the sealing component and has a second gas connection and a third gas connection, wherein the second gas connection is configured for connection to the first gas connection arranged on the frame;

wherein the lower tool and the hood are configured to form a sealing chamber in a closed state of the sealing tool;

a first line, which, in the closed state of the sealing tool, connects the second gas connection to the sealing chamber, the first line including a first line section and a second line section, wherein the first line section runs through the lower tool and, in the closed state of the sealing tool, is connected to the second line section, which leads to the second gas connection, at least partially runs through the hood, and is connected to the hood in an unmovable manner; and a second line, which, in the closed state of the sealing tool, connects the third gas connection to the sealing chamber, wherein a first line section of the second line runs through the lower tool and in the closed state of the sealing tool is connected to a second line section of the second line, which leads to the third gas connection, at least partially runs through the hood, and is connected to the hood in an unmovable manner;

wherein, in an open state of the sealing tool, the first line section of the first line is disconnected from the second line section of the first line, and the first line section of the second line is disconnected from the second line section of the second line;

wherein the hood is movable relative to the frame, and the sealing component carrier is fixed with respect to the frame so that the sealing component carrier is unmovable relative to the frame.

* * * * *